US006495301B2

(12) United States Patent
Everaars et al.

(10) Patent No.: US 6,495,301 B2
(45) Date of Patent: Dec. 17, 2002

(54) TONER COATED WITH CONDUCTIVE POLYMER

(75) Inventors: Marcel Dialma Everaars, Grashoek (NL); Ronald Michael Josef Hofstra, Venlo (NL); Peter Maria Cornelis Zeelen, Maasbree (NL); Huibert Cornelis Kwint, Woerden (NL)

(73) Assignee: Oce-Technologies B.V., MA Venlo (NL)

( * ) Notice: Subject to any disclaimer, the term of this patent is extended or adjusted under 35 U.S.C. 154(b) by 0 days.

(21) Appl. No.: 09/809,321

(22) Filed: Mar. 16, 2001

(65) Prior Publication Data

US 2001/0031416 A1 Oct. 18, 2001

(30) Foreign Application Priority Data

Mar. 16, 2000 (NL) ..... 1014657

(51) Int. Cl.[7] ..... G03G 9/00
(52) U.S. Cl. ..... 430/110.2; 430/110.3; 430/109.5

(58) Field of Search ..... 430/110.2, 110.3, 430/109.5

(56) References Cited

U.S. PATENT DOCUMENTS

| | | | | |
|---|---|---|---|---|
| 4,133,774 A | | 1/1979 | Brynko et al. | 252/62.1 |
| 5,077,167 A | * | 12/1991 | Ong et al. | 430/110.2 |
| 5,079,125 A | | 1/1992 | Anno et al. | 430/111 |
| 6,013,404 A | * | 1/2000 | Feng et al. | 430/106.6 |

FOREIGN PATENT DOCUMENTS

| | | |
|---|---|---|
| JP | 63066566 | 3/1988 |
| JP | 03100561 | 4/1991 |

* cited by examiner

*Primary Examiner*—John Goodrow
(74) *Attorney, Agent, or Firm*—Birch, Stewart, Kolasch & Birch, LLP

(57) ABSTRACT

A toner comprising separate toner particles each of which comprises a fixable core, the core being provided with a conductive surface layer containing a doped electrically conductive polymer and an intermediate layer, particularly a polymer-containing intermediate layer disposed between the surface layer and the core.

13 Claims, No Drawings

TONER COATED WITH CONDUCTIVE POLYMER

BACKGROUND OF THE INVENTION

The present invention relates to a toner comprising toner particles each comprising a core provided with a conductive surface layer containing a doped electrically conductive polymer. A toner of this kind is known from the pre-published Japanese Patent Application 3-100561. This toner, which is made up of a number of individual toner particles, can be used, for example, in an electrophotographic imaging process. By varying, for example, the thickness of the conductive surface layer, the resistance of the toner can be adjusted between 1 and $1*10^{13}$ ohm*m. The toner resistance is practically independent of the ambient conditions, particularly the air humidity.

This toner differs particularly from toners coated with more conventional conductive surface layers, for example surface layers containing carbon, conductive metal oxides or conductive resins, and has the disadvantage that the resistance of this toner changes sharply when the toner is exposed to mechanical loads. After the toner is provided with a conductive surface layer, it is exposed to various mechanical loads. These include, for example, the loads accompanying the transport of the toner to an image-forming apparatus, particularly a printer. In the printer the toner again experiences a number of mechanical loads, such as being transported from an internal supply to a developing unit and the continuous supply of the toner to said developing unit. A change in the resistance has the effect that the development characteristic of the toner changes, and this has an adverse effect on the quality of a printed image. Problems of this kind can be obviated by continuously measuring the toner resistance in the developing unit and adapting the development settings to the measured value. However, this solution is expensive and increases the sensitivity of the image-forming apparatus to malfunctioning. A second possible solution is to adjust the development settings manually, either by a service engineer or by the user himself, for example if the imaging quality has perceptibly deteriorated. On the one hand, this solution has the significant disadvantage that the imaging quality is not constant, while on the other hand adjusting the development settings by a service engineer is expensive.

SUMMARY OF THE INVENTION

The object of the present invention is to provide a toner which has better resistance to mechanical loads. To this end a toner has been developed wherein an intermediate layer is provided between the core and the surface layer. It has surprisingly been found that the toner according to the present invention has a much better resistance to mechanical loads. As a result, the toner resistance changes much less sharply, so that the printing quality of an image-forming apparatus is much more stable over time. The reason why the toner according to the present invention has a much better resistance to mechanical loads is not completely clear. Possibly, the intermediate layer results in a foundation which is stable and homogeneous both physically and chemically so that the electrically conductive surface layer adheres more satisfactorily. Another possibility is that the intermediate layer provides a change in the morphology of the core surface so that the surface layer acquires a different structure which is more resistant to the typical mechanical loads. There is also the possibility of an interaction between the intermediate layer and the surface layer so that the latter becomes mechanically stronger. In one preferred embodiment, the intermediate layer contains a polymer. The advantage of a material of this kind is the low cost and minimal environmental load. In another preferred embodiment, the glass transition temperature of the polymer is 70° C. or higher. As a result, the intermediate layer is practically unchangeable at the temperatures to which the toner is normally exposed in an image-forming apparatus, so that the good properties of the toner according to the present invention are maintained. In yet another preferred embodiment, the polymer has a glass transition temperature of 100° C. or higher, whereby the toner has even more stable properties. Preferably, the polymer is transparent so that the toner can be colored by applying to the core a coloring agent, more particularly a dye or pigment. The advantage of this is that a strong color can be obtained in a simple manner. The polymer is preferably selected from the group consisting of polymethyl methacrylate, polyvinyl alcohol, polyvinyl pyrrolidone and copolymers of maleic acid and olefins. The said olefins can, for example, be aliphatic, alicyclic or aromatic and may carry one or more substituents. More preferably, the polymer is a copolymer of maleic acid and aliphatic olefins. A copolymer of this kind yields very stable toners.

The core of the toner preferably contains a fixable polymer, for example a thermoplastic polymer or a pressure-sensitive polymer. Common polymers are the styrenes, styrene copolymers such as the styrene acrylates, styrene-butadiene copolymers and styrene maleic acid copolymers, polyethylenes, polypropylenes, polyesters, polyurethanes, polyvinyl chlorides, epoxy resins and so on. These can be used as a single component or as a mixture. Preferably, the polymer has a weight-averaged molecular weight of between 200 and 100,000. This molecular weight can, for example, be adapted to the required mechanical properties of the image or to the intrinsic properties of the image-forming process.

The conductive surface layer preferably contains a doped electrically conductive polymer derived from one or more of the monomers selected from the group consisting of thiophen, aniline, pyrrole or derivatives thereof. A polymer of this kind contains a conjugate chain, so that charge carriers can readily shift. In this chain the charge carriers are created via a doping process, particularly a chemical or electrochemical process. Processes of this kind comprise an oxidation or reduction reaction, in which electrons are removed or added to the polymer chain. Preferably again, the surface layer contains polyethylene dioxythiophen. This conductive polymer has the advantage of being practically colorless, so that the conductive surface layer has no disturbing effect on the color of the toner. The surface layer may be a closed layer around a toner particle but it may also form an unclosed layer, particularly in the form of conductive paths. In a further embodiment, the core also contains a magnetisable material so that it can be used in an image-forming process making use of unary conductive magnetic toner.

DETAILED DESCRIPTION OF THE INVENTION

The present invention will be further explained by reference to the following examples. All the reactions and experiments were carried out at room temperature.

Examples 1 to 6 describe how toner cores can be provided with an intermediate layer according to the present invention.

Examples 7 to 14 describe the preparation of a number of conductive toners according to the present invention.

Example 15 relates to an experiment concerning the resistance curve against mechanical loading of a number of toners according to the invention.

EXAMPLE 1

One kilogram of toner cores made up of 83 m % polyester resin, 15 m % magnetisable pigment and 2 m % of a cyan dye, which cores have a volume-averaged particle size distribution of 9–15 μm (d5–d95) were dispersed in 4 liters of tapwater in a 10 liter beaker glass. The stirring speed required for the purpose was about 350 rpm. 100 g of a 25 mass % solution of a copolymer of maleic acid and olefins (poly(maleic acid co-olefin) sodium salt, Aldrich) in water was added to this dispersion. The pH of the dispersion was then about 11. The dispersion was then acidified to a pH of 2 by slowly adding approximately 300 ml of a 1 molar HCl solution. The dispersion was stirred for a few more minutes. The particles were then filtered off and washed twice with 4 liters of tapwater. The particles were then dried in air. After drying, the particles coated with an intermediate layer were screened over a screen having a mesh width of 25 μm.

EXAMPLE 2

Just as in Example 1, particles were prepared with the difference that instead of the 25 m % solution of a copolymer of maleic acid and aliphatic olefins, a 25 m % solution of a copolymer of maleic acid and an aromatic olefin was used, in this case styrene, in water to form an intermediate layer over the cores.

EXAMPLE 3

25 g of the cores mentioned in Example 1 were dispersed in a 100 ml beaker glass in 20 ml of demineralised water provided with 1 g of the dispersant hexadecyl trimethyl ammonium bromide (CTAB). For this purpose the beaker glass was provided with a magnetic stirrer blade rotated at 150 rpm by a magnetic stirrer. 10 ml of demineralised water containing 0.99 g of polymethacrylic acid (PMA) was added dropwise to the dispersion over a period of about 5 minutes. The dispersion was then stirred for 30 minutes. The particles were then filtered off and washed with 20 ml of demineralised water. The particles were dried in air and after drying, screened over a screen having a mesh width of 25 μm.

EXAMPLE 4

100 g of the cores as mentioned in Example 1 were dispersed, in a closed reactor having a capacity of 2 liters, in a nitrogen atmosphere, in 500 ml of demineralised and oxygen-free water provided with 4.16 g of sodium formaldehyde sulphoxylate dihydrate. A solution of 2.2 g of tertiary butyl hydroperoxide in 14.9 g of methyl methacrylate was added, at a dispensing speed of 5 ml per minute, with vigorous stirring (about 300 rpm) with a stirring rod. The dispersion was then stirred for 40 minutes whereafter the particles were filtered off. The particles were washed three times with 500 ml of demineralised water each time and then dried in air. The particles were finally screened over a screen having a mesh width of 25 μm.

EXAMPLE 5

20 g of the toner cores as mentioned in Example 1 were dispersed, in a 100 ml beaker glass, in 50 ml of demineralised water provided with 0.5 g of polyvinyl alcohol. For this purpose the beaker glass was provided with a magnetic stirrer blade which was rotated by a magnetic stirrer at 150 rpm. The dispersion was stirred for 30 minutes. The particles were then filtered off and washed with 20 ml of demineralised water. The particles were dried in air and then screened over a screen having a mesh width of 25 μm.

EXAMPLE 6

20 g of the toner cores as mentioned in Example 1 were dispersed, in a 100 ml beaker glass, in 50 ml of demineralised water provided with 0.15 g of polyethylene imine. For this purpose the beaker glass was provided with a magnetic stirrer blade rotated by a magnetic stirrer at 150 rpm. The dispersion was stirred for 30 minutes. The particles were then filtered off and washed with 20 ml of demineralised water. The particles were dried in air and then screened over a screen having a mesh width of 25 μm.

EXAMPLE 7

The toner cores provided with an intermediate layer in accordance with Example 1 were provided, in this example, with a conductive surface layer of polyethylene dioxythiophen (PEDOT). For this purpose, 25 g of the particles were dispersed, in a 250 ml beaker glass, in 62.5 ml of a solution containing 1.44 g sodium dodecyl sulphate (SDS) per liter of demineralised water. 43.75 ml of a solution containing 2 g of ethylene dioxythiophen (PEDOT) per liter of demineralised water was added to this dispersion and 25 ml of demineralised water. 25 ml of an 0.1 molar cerium (IV)sulphate solution in 0.5 molar hydrochloric acid solution were added to this dispersion over a period of 30 seconds with a stirring speed of 300 rpm. This oxidising solution is used to allow oxydative polymerisation to take place and at the same time dope the resulting polymer. The dispersion was stirred for 1 minute whereafter the toner particles were filtered off, immediately washed with tapwater and then dried in air. Finally the toner particles were screened over a screen having a mesh width of 25 μm. The toner resistance was about 1E2 Ohmm.

EXAMPLE 8

A conductive toner was prepared in exactly the same way as in Example 7 except that the cerium(IV) sulphate solution was added over a period of 5 seconds. The toner obtained in this way had a resistance of about 8E3 Ohmm.

EXAMPLE 9

The conductive toner obtained according to Example 8 was provided, in a dry coating step, with an extra coating consisting of silica. For this purpose 200 g of this toner was transferred to a NARA HYBRIDIZER™ together with 0.1 mass % silica (R972, Degussa). The silica was then deposited on the toner by coating it for 20 seconds at 2500 rpm. As a result the resistance of the toner increased to 1E4 Ohmm. In this way the final resistance of a toner according to the invention can still be changed after the conductive coating has been applied.

EXAMPLE 10

A conductive toner was prepared in exactly the same way as in Example 7 except that the toner cores used as starting material were coated with an intermediate layer in accordance with Example 2. The final resistance of this toner is about 3E3 Ohmm.

EXAMPLE 11

The toner cores provided with a intermediate layer in accordance with Example 1 were provided, in this example, with a conductive surface layer containing polystyrene sulphonate in addition to polyethylene dioxythiophen. For this purpose, a quantity of 100 g of these toner cores provided with an intermediate layer was dispersed in 250 ml of a solution containing 1.44 g of sodium dodecyl sulphate per liter demi-water. 100 ml Baytron P (Bayer) was added to this dispersion, this product containing 0.8% polystyrene sulphonate in addition to 0.5% PEDOT. Over a period of about 30 minutes 100 ml of a solution containing 50 g of calcium chloride ($CaCl_2$) per liter was then added in drops. In these conditions a conductive complex of doped PEDOT and polystyrene sulphonate is precipitated on the particles. The dispersion was then filtered off and the toner particles were dried in air. Finally the toner was screened over a screen having a mesh width of 25 $\mu$m. The toner resistance was about 5E3 Ohmm. A conductive toner can easily be obtained in this way.

EXAMPLE 12

The toner cores provided with an intermediate layer in accordance with Example 1 were provided, in this example, with a conductive surface layer which in addition to polyethylene dioxythiophen contained a copolymer of maleic acid and olefins. For this purpose, 25 g of the particles were dispersed, in a 250 ml beaker glass, in 62.5 ml of a solution containing 1.44 g sodium dodecyl sulphate (SDS) per liter of demineralised water. 43.75 ml of a solution containing 2 g ethylene dioxythiophen (PEDOT) per liter of demineralised water was added to this solution and 25 ml demineralised water containing 1.4 g of a 25 mass % solution of a copolymer of maleic acid and olefins (poly)maleic acid-co-olefin) sodium salt, Aldrich). 25 ml of an 0.1 molar cerium (IV)sulphate solution in 0.5 molar hydrochloric acid solution was added to this dispersion over a period of 30 seconds at a stirring speed of 300 rpm. The dispersion was stirred for 1 minute after which the toner particles were filtered off, immediately washed with tapwater and then dried in air. Finally the toner particles were screened over a screen having a mesh width of 25 $\mu$m. The toner resistance was about 1 E5 Ohmm.

EXAMPLE 13

The toner cores provided with an intermediate layer in accordance with Example 1 were, in this example, provided with a conductive surface layer of polyaniline (PANI). For this purpose, a quantity of 25 g of the relevant particles was dispersed in 62.5 ml of a solution containing 1.44 g SDS per liter demineralised water. In addition to 62.5 ml of a solution containing 2 g aniline per liter of demineralised water, 125 ml of demineralised water was added to this dispersion. 38 ml of an 0.1 molar cerium(IV)sulphate solution in 0.5 molar hydrochloric acid solution was added to the resulting dispersion over a period of 30 seconds at a stirring speed of 300 rpm. The dispersion was stirred for 1 minute, after which the toner particles were filtered off, immediately washed with 100 ml of tapwater and then dried in air. Finally, the toner particles were screened over a screen having a mesh width of 25 $\mu$m. The final resistance of the toner was about 6E2 Ohmm.

EXAMPLE 14

The toner particles provided with an intermediate layer in accordance with Example 1 were provided, in this example, with a conductive surface layer of polypyrrole (PPy). For this purpose, a quantity of 25 g of the relevant particles was dispersed in 62.5 ml of a solution containing 1.44 g SDS per liter demineralised water. In addition to 62.5 ml of a solution containing 2 g pyrrole per liter demineralised water, 125 ml of demineralised water was added to this dispersion. 53 ml of an 0.1 molar cerium(IV)sulphate solution in 0.5 molar hydrochloric acid solution was added to the resulting dispersion over a period of 30 seconds at a stirring speed of 300 rpm. The dispersion was stirred for 1 minute, after which the toner particles were filtered off, immediately washed with 100 ml of tapwater and then dried in air. Finally, the toner particles were screened over a screen having a mesh width of 25 $\mu$m. The final resistance of the toner was about 1E6 Ohmm.

EXAMPLE 15

By means of the simple experiment described in this example, which took place under controlled conditions, it is possible to measure the influence of a mechanical load on the resistance of a toner. For this purpose, a 250 ml capacity glass pot was provided with 20 g of the toner under investigation and 100 g of glass beads having a cross-section of 0.6 mm. The pot was then placed on a roller bench and rotated at a peripheral speed of 25 meters per minute. After loading for a specific time, a toner sample was removed from the pot. The resistance of the toner was then measured. For this purpose, a hollow disc-shaped resistance cell was used provided with a circular Teflon base having a 3 cm diameter, an upright brass peripheral edge having a height of about 1 cm and a concentric circular brass inner edge having a diameter of about 1 cm and a height of about 1 cm. The peripheral edge and the inner edge serve as electrodes between which a quantity of toner is poured (about 6 ml). An AC voltage of about 1 volt was then applied at a frequency of 10 kHz across the two electrodes and the impedance of the toner was measured in Ohm*m.

In this way, the resistance curve of toners according to the invention was compared with the resistance curve of toners whose conductive surface layer has been applied to the same cores, i.e. the starting toner cores described in Example 1, but without an intermediate layer according to the present invention (reference toners). Thus experiments were carried out with toners coated with PEDOT, the conductive surface layer of the reference toner being applied in similar manner to Example 7, toners coated with PANI, the conductive surface layer of the reference toner being applied similarly to Example 13, and finally toners coated with PPy, the conductive surface layer of the reference toner being applied similarly to Example 14.

Table 1 shows how the resistance of the toners coated with PEDOT progresses. For simplification, the resistance of each of the toners was standardised at 1 (dimensionless) at t=0. The Table then indicates the factor by which the resistance increased after 60 minutes and 120 minutes respectively of mechanical loading as described above. The Table shows that the reference toner in the period under investigation experiences a change of resistance which is almost five times as high as that of the toners according to the invention. Table 2 indicates in similar manner to Table 1 how the resistance of the toners coated with PANI progresses. The Table shows that the reference toner in the period under investigation experiences a resistance change which is more than three times as high as that of the toner according to the invention. Table 3 in a similar manner to Table 1 shows how the resistance of the toners coated with PPy progresses. The Table shows that the reference toner in the period under investigation experiences a change of resistance which is approximately four times as high as that of the toner according to the present invention.

The toner according to the invention is not restricted to an intermediate layer containing a polymer. In other embodiments the intermediate layer may contain a crystalline material. The advantage of such a material is that it is relatively easy to apply and is not subject to changes provided the ambient temperature is lower than the melting temperature of the crystalline material. One example of a crystalline material is wax. Waxes have the additional advantage that the printed image has favorable mechanical properties. It appears that the image obtained using this toner is more resistant to frictional forces. The reason for this is not completely clear but it would appear that the wax is released from the intermediate layer to a greater or lesser degree when the toner is transferred to a receiving material. The wax then ensures that the top layer has a low coefficient of friction. It is also possible, for example, that the crystalline material contains a compound derived from a metal. The advantage of such a compound is that it can easily be applied by a dry coating technique. The compound can, for example, be a metal oxide such as tin oxide, silicon oxide or aluminium oxide. It is also possible to utilize a plurality of intermediate layers or intermediate layers which consist of a mixture of one or more polymers, crystalline materials, etc.

In addition to the components mentioned hereinbefore, it is possible, if necessary, to add to the toner other components sufficiently known from the literature, for example flow improvers, charge regulators, release agents, pigments, dyes, etc. Depending on all these components, the toner according to the invention can be used in various image-forming processes, such as electrostatography, electrophotography, inductography, magnetography, etc.

TABLE 1

Table 1: The resistance of toners coated with PEDOT against mechanical loading.

| toner | t = 0 (min) | t = 60 (min) | t = 120 (min) |
|---|---|---|---|
| example 7 | 1 | 0.6E2 | 3.2E2 |
| example 8 | 1 | 0.9E2 | 4.2E2 |
| example 9 | 1 | 0.7E2 | 3.7E2 |
| example 10 | 1 | 1.1E2 | 5.6E2 |
| example 11 | 1 | 1.0E2 | 5.1E2 |
| example 12 | 1 | 0.4E2 | 3.1E2 |
| reference | 1 | 2.8E2 | 14E2 |

TABLE 2

Table 2: The resistance of toners coated with PANI against mechanical loading.

| toner | t = 0 (min) | t = 60 (min) | t = 120 (min) |
|---|---|---|---|
| example 13 | 1 | 1.1E2 | 2.7E2 |
| reference | 1 | 2.2E2 | 9.0E2 |

TABLE 3

Table 3: The resistance of toners coated with PPy against mechanical loading

| toner | t = 0 (min) | t = 60 (min) | t = 120 (min) |
|---|---|---|---|
| example 14 | 1 | 0.9E2 | 4.9E2 |
| reference | 1 | 3.2E2 | 20E2 |

What is claimed is:

1. A toner comprising toner particles, each comprising a core provided with a conductive surface layer containing a doped electrically conductive polymer containing a conjugate chain, wherein an intermediate layer is disposed between the core and the conductive surface layer.

2. The toner according to claim 1, wherein the intermediate layer contains a polymer.

3. The toner according to claim 2, wherein the polymer has a glass transition temperature of greater than or equal to 70° C.

4. The toner according to claim 2, wherein the polymer has a glass transition temperature of greater than or equal to 100° C.

5. The toner according to claim 1, wherein the intermediate layer is transparent.

6. The toner according to claim 2, wherein the polymer of the intermediate layer is selected from the group consisting of polymethyl methacrylate, polyvinyl alcohol, polyvinyl pyrrolidone and copolymers of maleic acid and olefins.

7. The toner according to claim 6, wherein the polymer is a copolymer of maleic acid and aliphatic olefins.

8. The toner according to claim 1, wherein the core contains a fixable polymer.

9. The toner according to claim 8, wherein the fixable polymer has a weight-averaged molecular weight of between 200 and 100,000.

10. The toner according to claim 1, wherein the doped electrically conductive polymer is derived from at least one monomer selected from the group consisting of thiophen, aniline, pyrrole or derivatives thereof.

11. The toner according to claim 10, wherein the doped electrically conductive polymer is polyethylene dioxythiophen.

12. The toner according to claim 1, wherein the core contains a dye.

13. The toner according to claim 1, wherein the core contains a magnetisable material.

* * * * *